US006427294B1

(12) United States Patent
Shibaike et al.

(10) Patent No.: US 6,427,294 B1
(45) Date of Patent: Aug. 6, 2002

(54) WATERPROOF SLIDE FASTENER AND MANUFACTURING METHOD THEREOF

(75) Inventors: Masatoshi Shibaike; Masahiro Kusayama; Sakae Aimono, all of Toyoma-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/547,062

(22) Filed: Apr. 11, 2000

(30) Foreign Application Priority Data

Apr. 30, 1999 (JP) ..... 11-123557

(51) Int. Cl.[7] ..... A44B 19/10

(52) U.S. Cl. ..... 24/398; 24/381; 24/383; 24/397

(58) Field of Search ..... 24/398, 397, 381, 24/383

(56) References Cited

U.S. PATENT DOCUMENTS

| | | | | | |
|---|---|---|---|---|---|
| 3,456,306 | A | * | 7/1969 | Heimberger | 24/397 |
| 4,233,099 | A | | 11/1980 | McGuire | |
| 4,321,733 | A | * | 3/1982 | Yoshida | 24/397 |
| 4,350,721 | A | * | 9/1982 | Nagase | 24/398 |
| 4,566,156 | A | * | 1/1986 | Sarasue et al. | 24/398 |
| 4,651,389 | A | * | 3/1987 | Yoshida et al. | 24/398 |
| 5,728,460 | A | * | 3/1998 | Hirasawa et al. | 24/398 |
| 5,985,438 | A | * | 11/1999 | Watanabe | 428/343 |
| 6,231,979 | B1 | * | 5/2001 | Nagamine et al. | 428/379 |

FOREIGN PATENT DOCUMENTS

| | | | |
|---|---|---|---|
| EP | 0111788 | 6/1984 | |
| EP | 0111889 | 6/1984 | |
| EP | 0162350 | 11/1985 | |
| EP | 0164610 | 12/1985 | |
| GB | 1167778 | * 10/1969 | 24/397 |
| WO | WO0018270 | 4/2000 | |

OTHER PUBLICATIONS

European Search Report dated Aug. 8, 2000.

* cited by examiner

*Primary Examiner*—Victor Sakran
(74) *Attorney, Agent, or Firm*—Finnegan, Henderson, Farabow, Garrett & Dunner, LLP

(57) ABSTRACT

The present invention intends to provide a waterproof slide fastener in which a synthetic resin film is fused to a fastener tape in order to prevent a perforation phenomenon that the synthetic resin film does not exist locally. A laminated synthetic resin film composed of low melting point resin layer having melting point of, for example, 100° C.–140° C. and high melting point resin layer having melting point of, for example, 150° C.–230° C. is fused to a surface or both surfaces of a pair of the fastener tapes with the low melting point resin layer being in contact with and opposing the fastener tape by heating with pressure. Fastener elements are mounted onto a side edge of the fastener tape and the laminated synthetic resin film is formed so as to protrude outward from the side edge of the fastener tape and a center point of coupling of the fastener elements. Because the high melting point resin layer disposed on the surface of the fastener tape is not melted, no perforation phenomenon occurs. Further, because the laminated synthetic resin film protrudes from the side edge, waterproof function is secured.

9 Claims, 10 Drawing Sheets

WATERPROOF SLIDE FASTENER AND MANUFACTURING METHOD THEREOF

BACKGROUND OF THE INVENTION

1. Field of the Invention

The present invention relates to a waterproof slide fastener for use as an opening/closing device of ski wear, sports bag and the like by providing a fastener tape of the slide fastener with waterproof function, and a manufacturing method of the same slide fastener having the waterproof.

2. Description of the Related Art

Conventionally, a fastener tape having synthetic resin film fused on entire one side surface of a pair of right and left fastener tapes has been well known. According to a slide fastener disclosed in Japanese Utility Model Publication No. 40-17549, as shown in FIG. 19, for example, synthetic resin film 4' is overlaid and fused to cover an entire rear surface of the pair of the right and left fastener tapes 3' and a core thread 7' is fixed to a side edge 11' of the fastener tape 3'. Then, fastener elements 5' are attached to this core thread fixing portion so as to complete a slide fastener having waterproof.

In the conventionally known slide fastener in which synthetic resin film is fused on the entire surface of the pair of the fastener tapes, a single layer synthetic resin film is fused on the fastener tape by heating. As a result, a synthetic resin film does not exist locally on the surface of the fastener tape or holes are made due to threading of sewing yarns, which is so-called perforation phenomenon, occurs so that there is generated a problem that the waterproof of the fastener tape is lost. Further, melted synthetic resin film is likely to be affixed to not only the fastener tape but also a heating/pressure body for applying pressure and heating. Therefore, there is a problem that heating processing control for fusing the synthetic resin film onto the fastener tape securely is difficult.

SUMMARY OF THE INVENTION

The present invention has been achieved in views of the above described problems. An object of the invention is to provide a waterproof slide fastener in which a laminated synthetic resin film comprised of low melting point resin layer and high melting point resin layer is used as a synthetic resin film to be fused to a fastener tape so as to prevent a perforation phenomenon in the synthetic resin film, and the synthetic resin film is fused securely to the fastener tape.

Another object of the invention is to provide a slide fastener chain having waterproof in which, by specifying melting points of the low melting point resin layer and high melting point resin layer of the laminated synthetic resin film, only the low melting point resin layer is melted at a temperature in which the high melting point resin layer is not melted by heating with pressure so that the low melting point resin layer is fused securely to the fastener tape.

Another object of the invention is to provide a slide fastener having waterproof in which the laminated synthetic resin film is fused so as to intensify waterproof function at the side edge in which the right and left fastener tapes collide when the right and left fastener stringers are coupled.

Another object of the invention is to provide a slide fastener having waterproof in which the waterproof of the slide fastener can be attained even when the laminated synthetic resin film is fused to any one of front and rear surfaces of the right and left fastener tapes.

Another object of the invention is to provide a slide fastener having waterproof in which waterproofing style is defined to secure waterproof at a portion in which the linear fastener elements are sewn when the laminated synthetic resin film is fused on the surface of both the right and left fastener tapes so as to achieve an effective waterproof.

Another object of the invention is to provide a slide fastener having waterproof in which the laminated synthetic resin film is fused to both the front and rear surfaces of the fastener tape forming a fastener stringer and linear fastener elements are sewn onto both the front and rear surfaces so as to achieve airtightness and watertightness.

An object of another aspect of the invention is to provide a manufacturing method of a slide fastener having waterproof capable of producing a fastener chain in which the laminated synthetic resin film composed of the low melting point resin layer and high melting point resin layer is used as a synthetic resin film to be fused to the fastener tape so as to prevent a perforation phenomenon in the synthetic resin film and the synthetic resin film is fused securely to the fastener tape.

Another object of the invention is to provide a manufacturing method of a slide fastener having waterproof capable of producing a fastener chain having an excellent waterproof function easily and securely.

To achieve the above object, according to one aspect of the invention, there is provided a waterproof slide fastener, wherein a laminated synthetic resin film composed of low melting point resin layer and high melting point resin layer is fused to a surface or both surfaces of each of a pair of right and left fastener tapes in the slide fastener such that the low melting point resin layer is in contact with and opposes the surface of the fastener tape by heating with pressure, while fastener elements are mounted on a side edge of the fastener tape by sewing for example, coil-shaped or zigzag shaped fastener elements formed of monofilament to the fastener tape or weaving or knitting the coil-shaped linear fastener elements into the fastener tape or crimping or injection-molding discrete fastener elements of metal or synthetic resin.

Preferably, the laminated synthetic resin film is comprised of the low melting point resin layer having melting point of 100° C.–140° C. and the high melting point resin layer having melting point of 150° C.–230° C.

Still preferably, the laminated synthetic resin film is comprised of the low melting point resin layer having melting point of 110° C.–130° C. and the high melting point resin layer having melting point of 160° C.–200° C.

Preferably, the laminated synthetic resin film to be fused to the fastener tape is formed so as to protrude from the side edge of the right and left fastener tapes and a center point of coupling of the fastener elements mounted on the side edge.

Also preferably, the fastener elements are mounted on the front surfaces of the opposing side edges of the right and left fastener tapes and the laminated synthetic resin film is fused on entire rear surfaces of the fastener tapes.

Preferably, the laminated synthetic resin film is fused on the entire front surface of each of the right and left fastener tapes and the fastener elements are mounted on the laminated synthetic resin film fused to the front surface of the side edge opposing each other of the fastener tape.

Further preferably, the laminated synthetic resin film is fused on the entire surface of each of the right and left fastener tapes and coil-shaped or zigzag-shaped linear fastener elements are sewn onto the laminated synthetic resin film fused to the front surface of the side edge opposing each other of the fastener tape while a portion of a rear face of the tape to which the linear fastener elements 5 are sewn is treated with waterproof finish.

Alternatively, the laminated synthetic resin film is fused on the entire surface of each of the right and left fastener tapes and coil-shaped or zigzag-shaped linear fastener elements are sewn onto the laminated synthetic resin film fused to the front surface of the side edge opposing each other of the fastener tape, while sewing yarns with which the linear fastener elements are fixed are treated with waterproof finish.

And preferably, the laminated synthetic resin film is fused on the entire surface of each of the right and left fastener tapes, a pair of the coil-shaped or zigzag-shaped linear fastener elements are disposed and sewn on the front surface of the fused laminated synthetic resin film such that they oppose and coupling heads of the linear fastener elements oppose each other across a predetermined interval, the fastener tape is bent at the middle between the pair of the sewn linear fastener elements so as to overlap, while the overlapping faces of the fastener tape are bonded to each other so as to ensure airtightness and watertightness.

According to another aspect of the invention, there is provided a manufacturing method of a waterproof slide fastener comprising the steps of: mounting fastener elements on the front surface of a side edge opposing each other of each of a pair of right and left fastener tapes; after coupling the right and left fastener elements, heating a laminated synthetic resin film composed of low melting point resin layer and high melting point resin layer under pressure to an entire rear surface of each of the pair of the combined right and left fastener tapes, with the low melting point resin layer being in contact with and opposing the fastener tape, so as to fuse the low melting point resin layer to the fastener tape; and cutting the laminated synthetic resin film between the right and left fastener tapes so as to produce a fastener chain.

Preferably, after the right and left fastener elements mounted on the surface of the side edge opposing each other of each of a pair of the right and left fastener tapes are coupled, the fastener elements are kept with a gap between opposing side edges thereof by pulling the right and left fastener tapes to the right and left or arranging the fastener elements in a mountain shape to project toward the fastener tape side while the laminated synthetic resin film is fused to the fastener tapes by heating with pressure.

DESCRIPTION OF THE PREFERRED EMBODIMENTS

Hereinafter, the embodiments of a waterproof slide fastener and a manufacturing method thereof according to the present invention will be described in detail with reference to the accompanying drawings.

In the slide fastener having waterproof of the present invention, a fastener tape 3 is produced by weaving or knitting synthetic resin fiber such as polyamide fiber and polyester fiber and two-layer laminated synthetic resin film 4 composed of low melting point resin layer 12 and high melting point resin layer 13 is fused on a surface of this fastener tape 3 by heating under pressure. As a result, this slide fastener has waterproof function.

Figure 1:
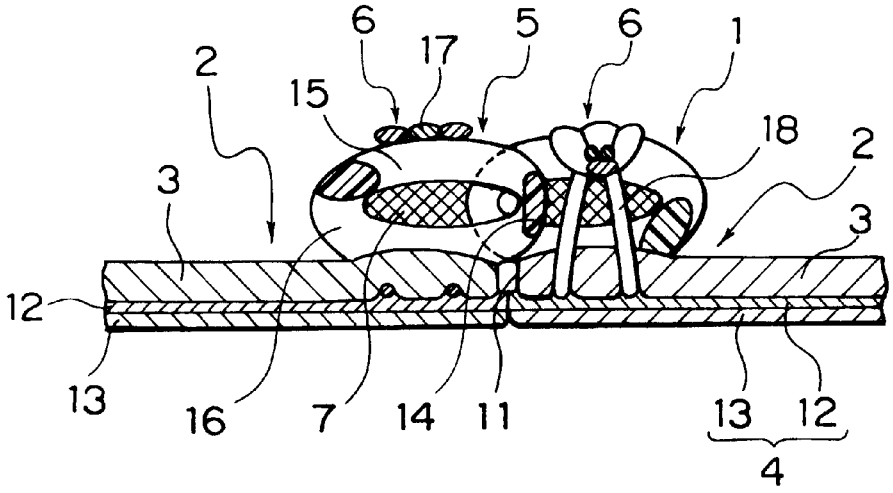
FIG. 1 is a sectional view of a fastener chain according to a first embodiment of a slide fastener having waterproof.
Figure 2:
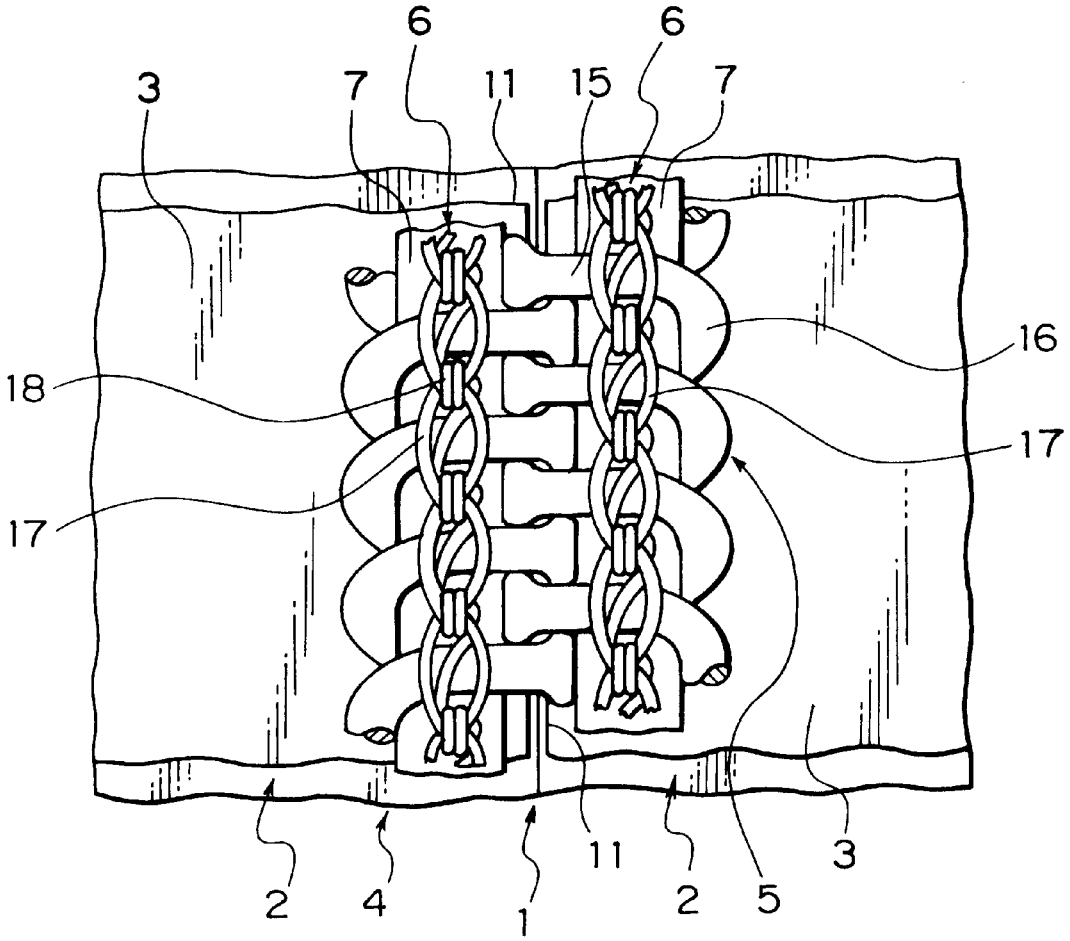
FIG. 2 is a plan view of the same fastener chain.

In the slide fastener having waterproof according to a first embodiment shown in FIGS. 1 and 2, with a core thread 7 inserted through inside of linear type coil-shaped fastener elements 5 formed of monofilament of synthetic resin such as polyamide and polyester, leg portions 15 of the coil-shaped fastener elements 5 are sewn onto the surface of a side edge 11 of the fastener tape 3 with sewing yarns 6 of multi-thread chain stitch of a sewing machine so as to form a fastener stringer 2. Then, right and left fastener stringers 2 are coupled to form a fastener chain 1.

Figure 3:
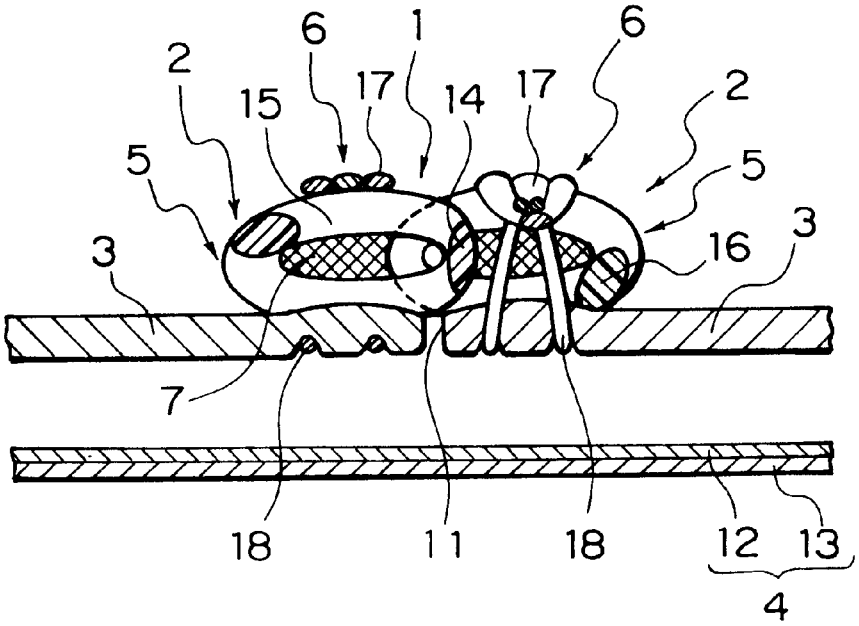
FIG. 3 is a sectional view before laminated synthetic resin film is fused onto the same fastener chain.

As shown in FIG. 3, the laminated synthetic resin film 4 is produced by bonding together the low melting point resin layer 12 and high melting point resin layer 13 each made of urethane base resin or coating the low melting point resin layer 12 on the high melting point resin layer 13. The melting point of the low melting point resin layer is 100° C.–140° C., preferably 110° C.–130° C. The melting point of the high melting point resin layer is 150° C.–230° C., preferably 160° C.–200° C. It i s permissible to use polyester base resin instead of urethane base resin. Further, by employing thermoplastic elastomer as material of the laminated synthetic resin film 4, it is possible to produce a flexible slide fastener chain 1 having waterproof.

With the laminated synthetic resin film 4 disposed such that the low melting point resin layer 12 faces a pair of the fastener tapes 3 on the rear face of the fastener chain 1 as shown in FIG. 1, the laminated synthetic resin film 4 is heated under pressure so as to be fused to an entire surface of the A fastener tape 3. Then, the laminated synthetic resin film 4 disposed so as to span between the side edges 11 of the right and left fastener tapes 3 is cut between the side edges 11 so as to form the fastener chain 1.

The cut laminated synthetic resin film 4 protrudes from the side edge 11 of each fastener tape 3. Further, when coupling heads 14 of the right and left coil-shaped fastener elements 5 couple with each other, the cut laminated synthetic resin films 4 protrude from a center point of the coupling. Therefore, when the coil-shaped fastener elements 5 of the right and left fastener stringers 2 couple with each other, the laminated synthetic resin films 4 protruding from the side edge 11 of the fastener tape 3 collide with the mating one thereby achieving waterproof function. Upon use of this fastener chain 1, the fastener chain is sewn onto an object to be attached, with a side in which the laminated synthetic resin film 4 is fused being a front side and the side in which the coil-shaped fastener elements 5 are attached being a rear side.

Meanwhile, the laminated synthetic resin film 4 may be transparent or semi-transparent and in this case, a color of the fastener tape 3 can be seen through the film. Further, it is also permissible to provide this laminated synthetic resin film 4 with unevenness pattern or fabric pattern by embossing the surface of the high melting point resin layer 13. As a result, the surface of the laminated synthetic resin film 4 can be matted and adhesion performance thereof to the object to be attached is improved.

Figure 4:
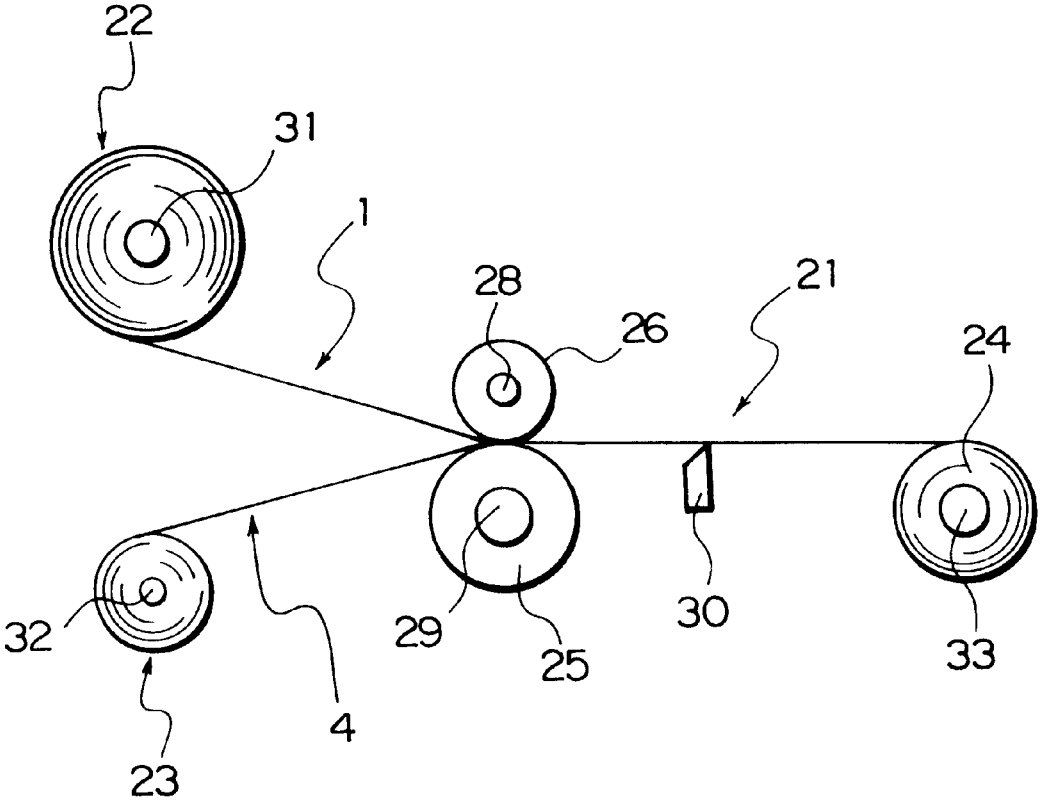
FIG. 4 is a schematic diagram showing manufacturing process of the same fastener chain.
Figure 5:
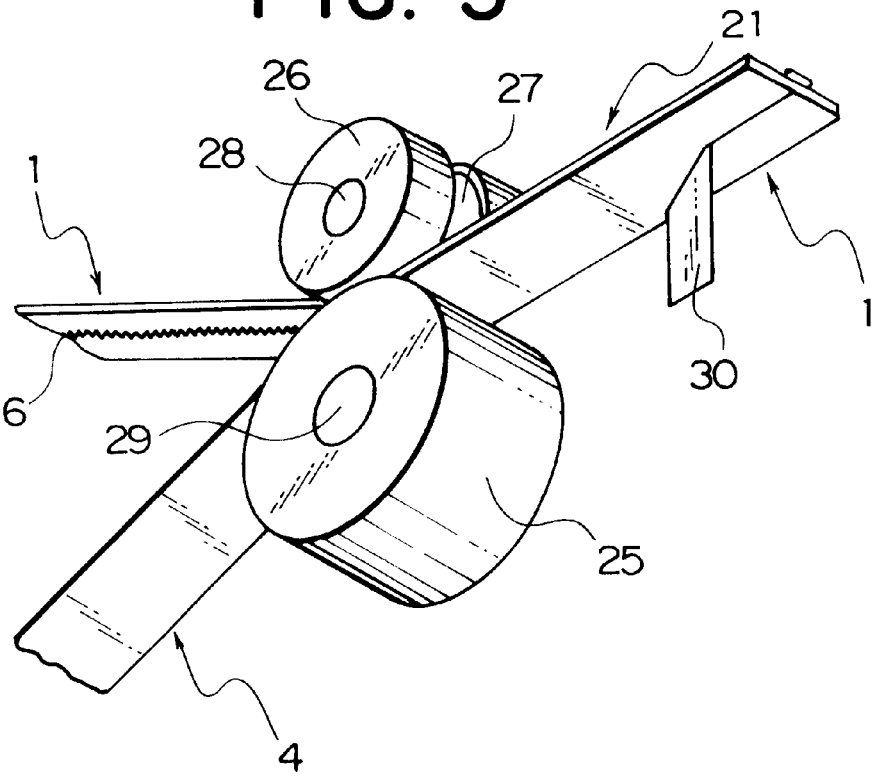
FIG. 5 is a perspective view showing a heating/pressurizing step in the manufacturing process of the same fastener chain.

Next, a manufacturing method of the slide fastener having waterproof will be explained. In a step for fusing the laminated synthetic resin film 4 to the fastener chain 1, as shown in FIGS. 4 and 5, the fastener chain 1 is wound around a bobbin supported by a supporting shaft 31 acting as a fastener chain supplying portion 22 and introduced between a heating roller 25 journaled by a rotation shaft 29 and a pressure roller 26 journaled by a rotation shaft 28. Finally, the fastener chain 1 is wound up around a winding roller 24 journaled by a driving shaft 33.

At this time, the laminated synthetic resin f film 4 wound around a bobbin supported by a supporting shaft 32 provided as a laminated synthetic resin film supplying portion 23 separately from the fastener chain supplying portion 22 is transferred to between the heating roller 25 and pressure roller 26. The fastener chain 1 and the laminated synthetic resin film 4 pass between the heating roller 25 and pressure roller 26, with the fastener chain 1 and the low melting point resin layer 12 of the laminated synthetic resin film 4 opposing each other in contact, so that the low melting point resin layer 12 is melted by the heating roller 25 and the pressure roller 26 and fused to the fastener tape 3. As a result, the laminated synthetic resin film 4 is mounted to the fastener chain 1.

In a step just before the fastener chain 1 in which the laminated synthetic resin film 4 is fused is wound up around the winding roller 24, the laminated synthetic resin film 4 which spans between the side edges 11 opposing each other of the fastener tapes 3 is cut in the center between the side edges 11 by a cutter 30 disposed in a cutting portion 21. As a result, the integral fastener chain 1 can be separated to right and left fastener stringers 2.

In a fusing step, a concave groove portion 27 is provided in the surface of the pressure roller 26 as shown in FIG. 5 so that the coupled coil-shaped fastener elements 5 of the fastener chain 1 are inserted therein and guided thereby. Further, because only the low melting point resin layer 12 is melted and bonded while the high melting pint resin layer 13 is not melted when the laminated synthetic resin film 4 is fused, the perforation phenomenon due to heating under pressure is not generated so that the surface is kept smooth.

Figure 6:
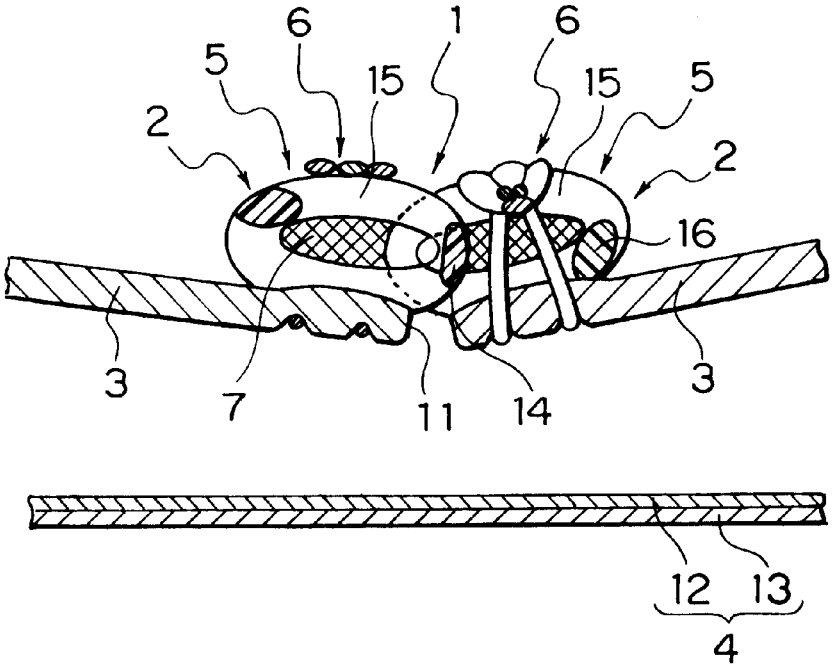
FIG. 6 is a sectional view showing a modification of fusion of the laminated synthetic resin film onto the same fastener chain, in a step prior to the fusion.

A step of fusing the laminated synthetic resin film 4 to the fastener chain 1 shown in FIG. 6 has a feature in that the fastener tape 3 and laminated synthetic resin film 4 are bonded together such that a slightly larger amount of the laminated synthetic resin film 4 exists between the side edges 11 opposing each other of the right and left fastener tapes 3 in the fastener chain 1 as compared to the above described example in order to intensify waterproof. That is, the surface of the pressure roller 26 shown in FIG. 5 is formed in a mountain shape which protrudes gradually toward the center of the surface and on the other hand, the surface of the heating roller 25, provided so as to oppose the pressure roller 26, is formed in a V shape which deepens gradually toward the center of the surface. By passing the fastener chain 1 between the pressure roller 26 and heating roller 25, an interval between the side edges 11 of the right and left fastener tapes 3 is expanded so that the laminated synthetic resin film 4 longer than an ordinary dimension of the interval between the side edges 11 can be disposed so as to span between the side edges 11. As a result, after the laminated synthetic resin film 4 between the side edges 11 is cut, the cut ends of the laminated synthetic resin film 4 collide with each other firmly to close the gap thereby preventing water leakage between the cut ends. Consequently, the waterproof effect at the side edges 11 of the fastener tapes 3 can be intensified. Meanwhile, it is permissible to expand the interval between the side edges 11 of the fastener chain 1 by pulling the fastener tapes 3 to the right and left in the fastener chain 1 in which the right and left fastener stringers 2 couple with each other.

Figure 7:
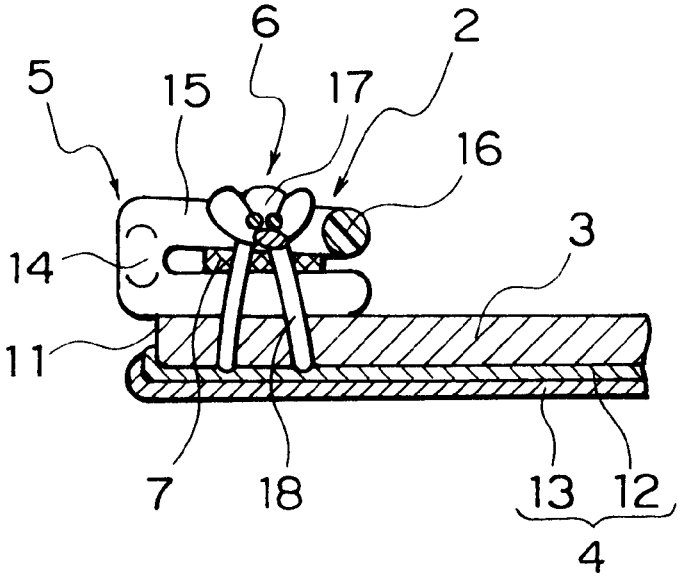
FIG. 7 is a sectional view of a fastener stringer showing a modification of linear fastener elements of the same fastener chain.

FIG. 7 shows a modification of the linear fastener elements 5. In the linear fastener elements 5 of this modification, synthetic resin monofilament is formed in zigzag shape and a center point of the elements is bent. Then, so-called the zigzag type, i.e., the zigzag shaped fastener elements 5 are sewn onto the surface of the side edge 11 of the fastener tape 3. The core thread 7 is interposed and held between upper and lower leg portions 15 and this core thread 7 is sewn with the sewing yarns 6 of the multi-thread chain stitch. The right and left fastener stringers 2 are coupled with each other to form the fastener chain 1 and then, the laminated synthetic resin film 4 is fused to the entire surface of the rear face of the fastener chain 1. Next, the fused laminated synthetic resin film 4 is cut between the side edges 11 of the right and left fastener tapes 3 so that the fastener chain 1 is separable to the right and left portions. In this fastener stringer 2 also, the side of the laminated synthetic resin film 4 is exposed outside.

Figure 8:
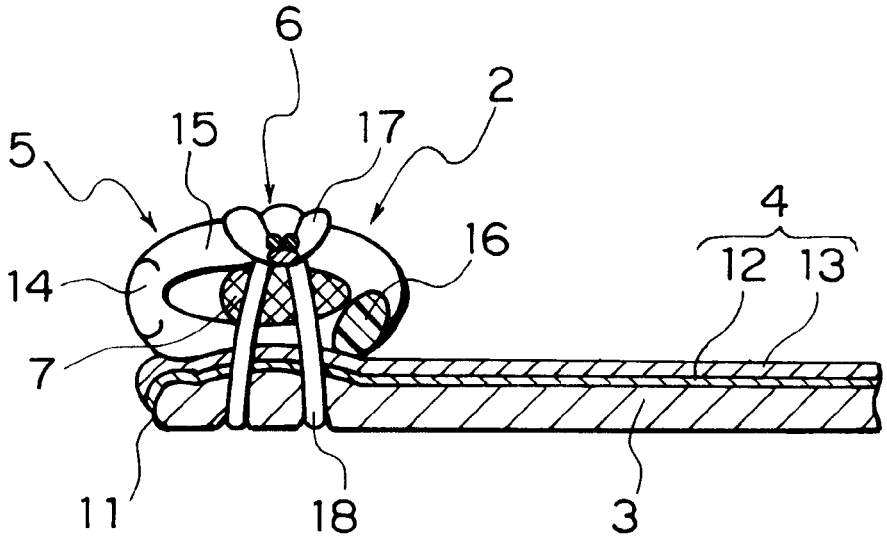
FIG. 8 is a sectional view of a fastener stringer according to a second embodiment of the slide fastener having waterproof.

In the fastener stringer 2 of the slide fastener having waterproof according to a second embodiment shown in FIG. 8, the laminated synthetic resin film 4 is fused on the side in which the coil-shaped fastener elements 5 are sewn. The two-layer laminated synthetic resin film 4 composed of the low melting point resin layer 12 and high melting point resin layer 13 is disposed on the surface of the fastener tape 3, and it is placed such that the low melting point resin layer 12 opposes the fastener tape 3 and fused thereto by heating under pressure. At the same time, the laminated synthetic resin film 4 is fused such that it protrudes from the side edge 11 of the fastener tape 3.

By sewing the leg portions 15 of the coil-shaped fastener elements 5 to the surface of the side edge 11 of the fastener tape 3 in which the laminated synthetic resin film 4 is fused with the sewing yarns 6 of the multi-thread chain stitch, the fastener stringer 2 is completed. When this fastener stringer 2 is used, the coil-shaped fastener element 5 is attached to an object to be attached so that it is exposed on the front surface of the object. Further, by processing the sewing yarns 6 themselves in water repellent finish, no water penetrates in the sewing yarns 6 and reaches the rear face of the fastener tape 3. As a result, the waterproof effect is further intensified.

Figure 9:
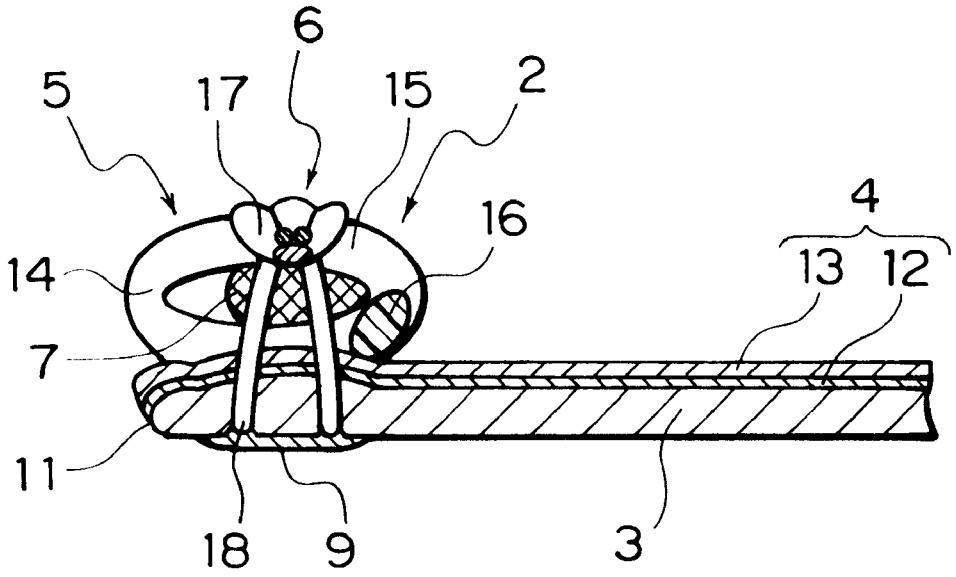
FIG. 9 is a sectional view of a fastener stringer showing a modification of the same fastener stringer.

In the fastener stringer 2 of another modification of the second embodiment shown in FIG. 9, the coil-shaped fastener elements 5 are sewn onto the front surface of the side edge 11 of the fastener tape 3 with the sewing yarns 6, and the rear surface of the fastener tape 3 at a portion of the sewing yarns 6 is coated with synthetic resin sealing agent 9 or synthetic resin paint 9 to prevent water leakage along the sewing yarns 6 to the rear surface of the fastener tape 3. As a result, the waterproof effect is further intensified.

Figure 10:
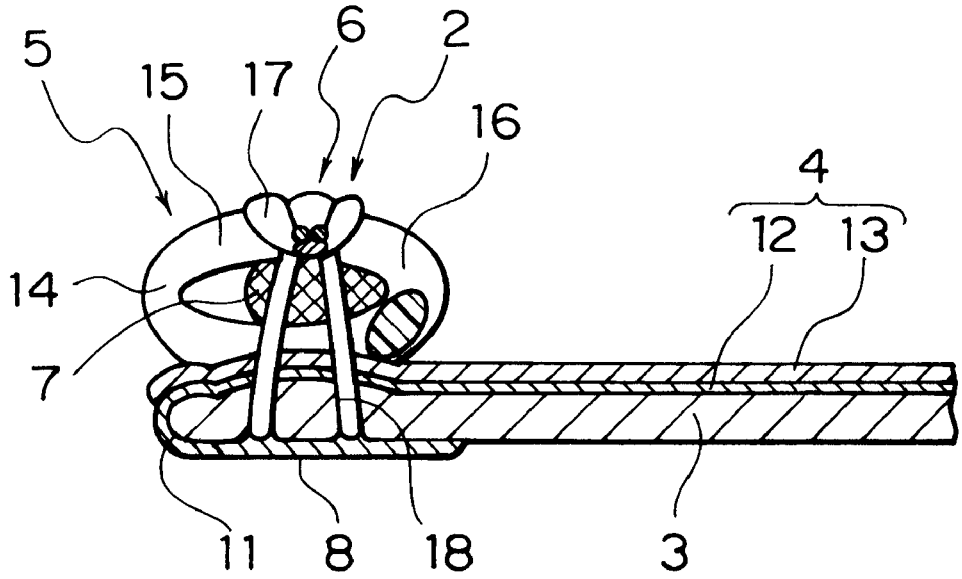
FIG. 10 is a sectional view of a fastener stringer showing another modification of the same fastener stringer.

In the fastener stringer 2 of still another modification of the second embodiment shown in FIG. 10, the coil-shaped fastener elements 5 are sewn with the sewing yarns 6 onto the front surface of the side edge 11 of the fastener tape 3 whose surface is coated with the laminated synthetic resin film 4. A synthetic resin film 8 is bonded or fused to the rear surface of this fastener tape 3 at the portion of the sewing yarns 6 so as to intensify the waterproof effect. Meanwhile, it is permissible to make an end of the synthetic resin film 8 in contact with the laminated synthetic resin film 4.

Figure 11:
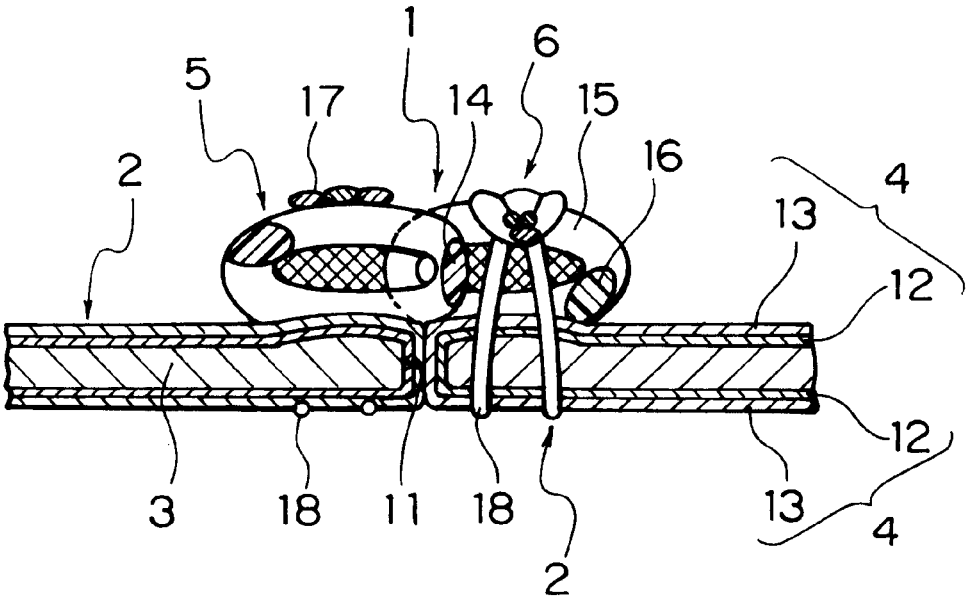
FIG. 11 is a sectional view of a fastener chain showing a modification of the same fastener stringer.

In the fastener chain 1 of yet another modification of the second embodiment shown in FIG. 11, the laminated synthetic resin film 4 is disposed entirely on the front and rear surfaces of the fastener tape 3 and fused to the fastener tape 3 by heating under pressure. Then, the coil-shaped fastener elements 5 are sewn with the sewing yarns 6 onto the surface of the side edge 11 of the fastener tape 3 whose front and rear surfaces are covered with the laminated synthetic resin film 4. Then, the laminated synthetic resin film 4 is fused to the fastener tape 3 such that the ends thereof protrude across a center point in which the right and left coil-shaped fastener elements couple with each other, so as to prevent water leakage along a colliding face of the right and left fastener stringers 2.

Figure 12:
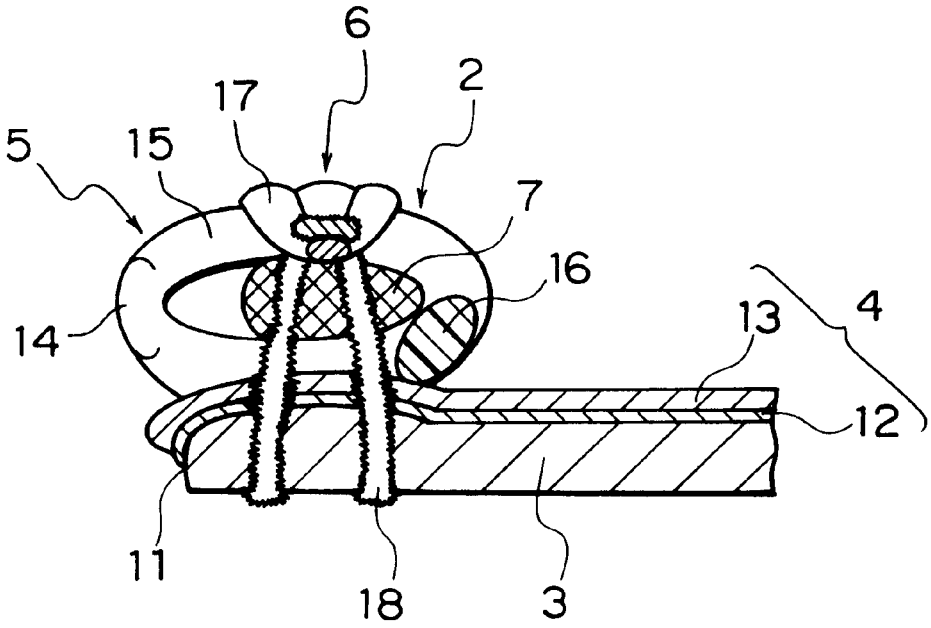
FIG. 12 is a sectional view of a fastener stringer showing a modification of the same fastener stringer.

In the fastener stringer 2 of yet another modification of the second embodiment shown in FIG. 12, while the coil-shaped fastener elements 5 of the fastener stringer 2 are sewn onto the fastener tape 3 with the sewing yarns 6 of the multi-thread chain stitch as shown in FIG. 11, a hot melting yarn is used as a needle yarn 18 of the sewing yarns 6 of the multi-thread chain stitch. As a result, the needle yarn 18 is melted by heating so that it is fused to the laminated synthetic resin film 4 or the melted yarn buries a gap around the needle yarn 18 so as to prevent water leakage around the needle yarn 18. Meanwhile, it is permissible to use the hot melting yarn for a looper yarn 17.

Figure 13:
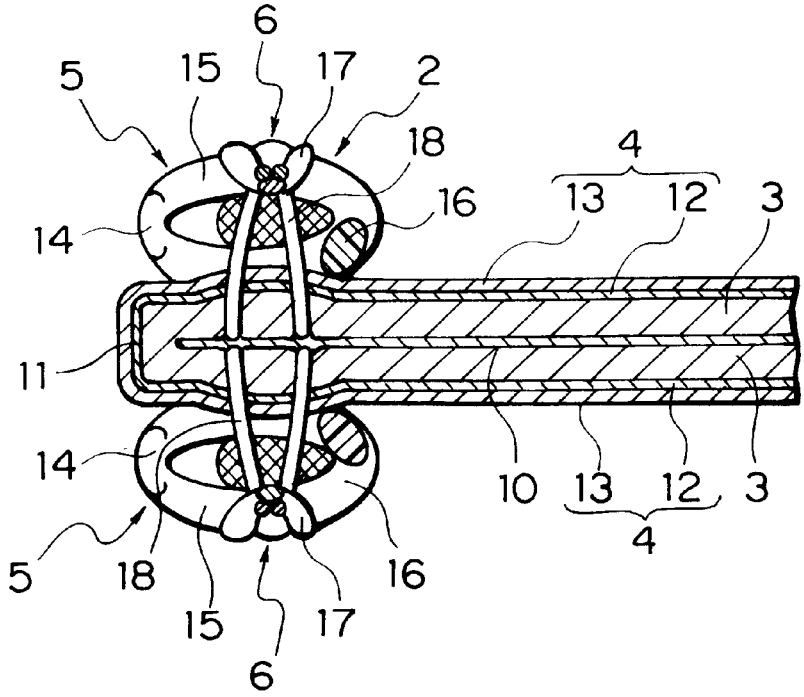
FIG. 13 is a sectional view of a fastener stringer according to a third embodiment of the slide fastener having waterproof.

In the fastener stringer 2 of the slide fastener having waterproof according to a third embodiment shown in FIG. 13, the laminated synthetic resin film 4 composed of the low melting point resin layer 12 and high melting point resin layer 13 is fused to the entire surface of the fastener tape 3. A pair of the coil-shaped fastener elements 5 are disposed on the laminated synthetic resin film 4 fused to the fastener tape 3 so as to oppose each other across a predetermined interval, that is, sewn with the sewing yarns 6 of the multi-thread chain stitch such that the coupling heads 14 oppose each other with the predetermined interval. In this case, the fastener tape 3 is folded back in the gap between the pair of the coil-shaped fastener elements 5 so that the two folded portions are overlaid and the opposing faces of the fastener tape 3 are bonded to each other by synthetic resin adhesive agent 10. In this case, the coil-shaped fastener elements 5 exist on both the front and rear surfaces of the fastener stringer 2.

In this fastener stringer 2, when the fastener tape 3 is folded back and the two folded portions are overlaid, it is so constructed that an end edge of the laminated synthetic resin film 4 at the side edge 11 of the fastener tape 3 protrudes with respect to the coupling head 14 of the right and left coil-shaped fastener elements 5. As a result, a slide fastener having high airtightness and watertightness can be achieved.

Figure 14:
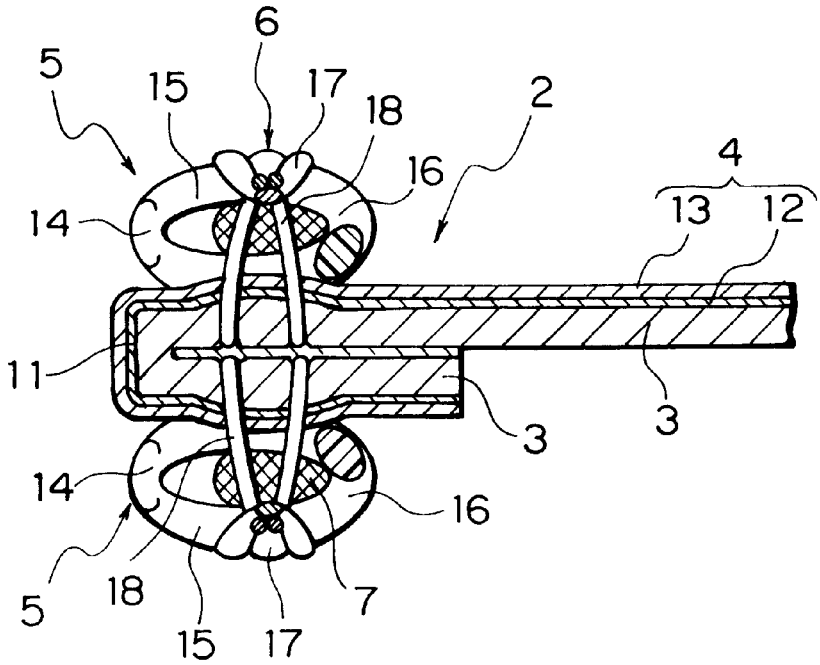
FIG. 14 is a sectional view of a fastener stringer showing a modification of the same fastener stringer.
Figure 15:
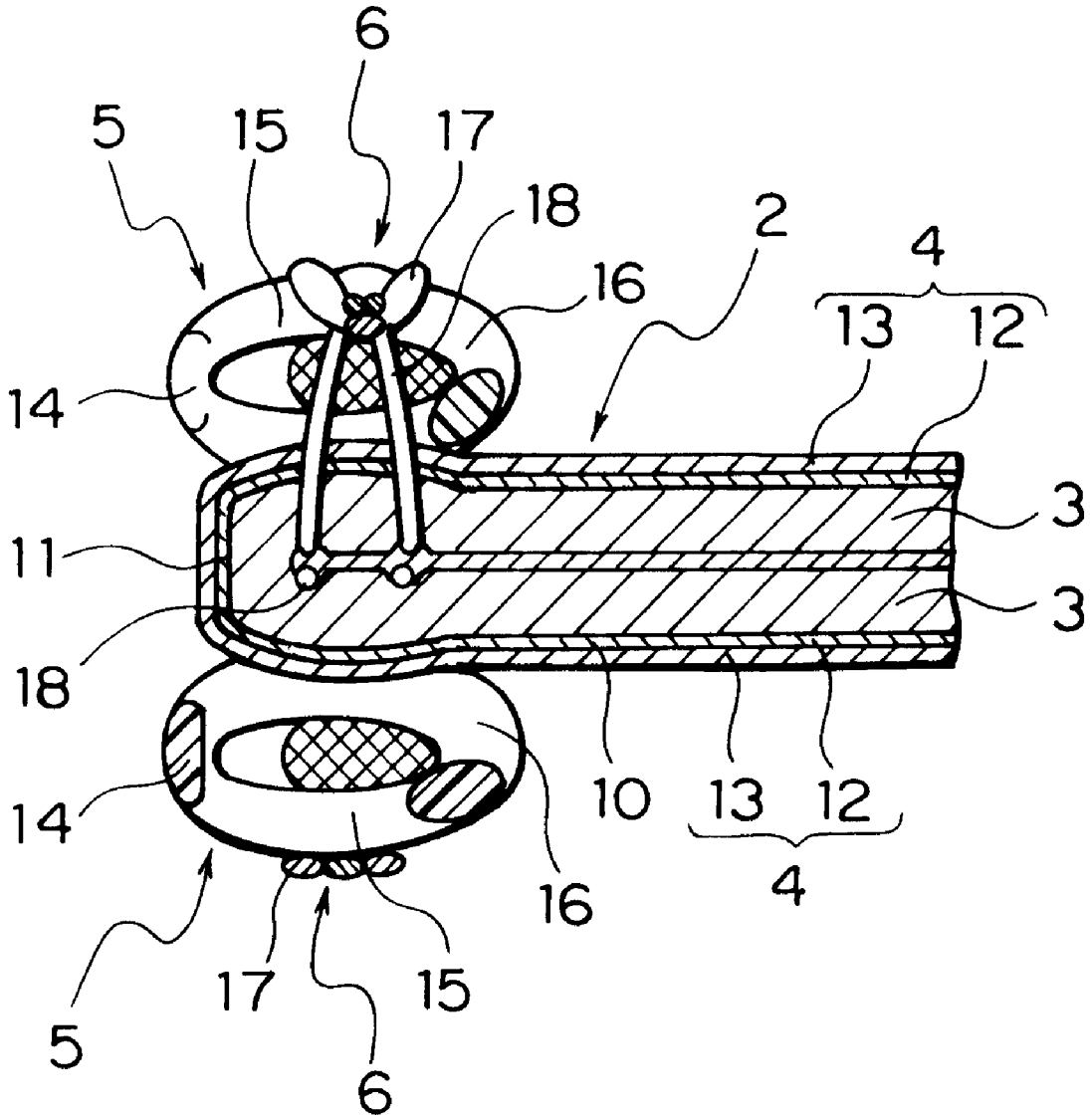
FIG. 15 is a sectional view of a fastener stringer showing another modification of the same fastener stringer.

In the fastener stringer 2 of a modification of the third embodiment shown in FIG. 14, by restricting the overlaying portion of the fastener tape 3 in the fastener stringer 2 shown in FIG. 13 to a portion in which the coil-shaped fastener elements 5 are sewn, reduction of the material cost is intended. Further, the fastener stringer 2 of another modification shown in FIG. 15 is so formed that when the right and left coil-shaped fastener elements 5 couple with each other, the end edges of the laminated synthetic resin film 4 fused to the fastener tape 3 protrude slightly from the center point of the coupling.

Figure 16:
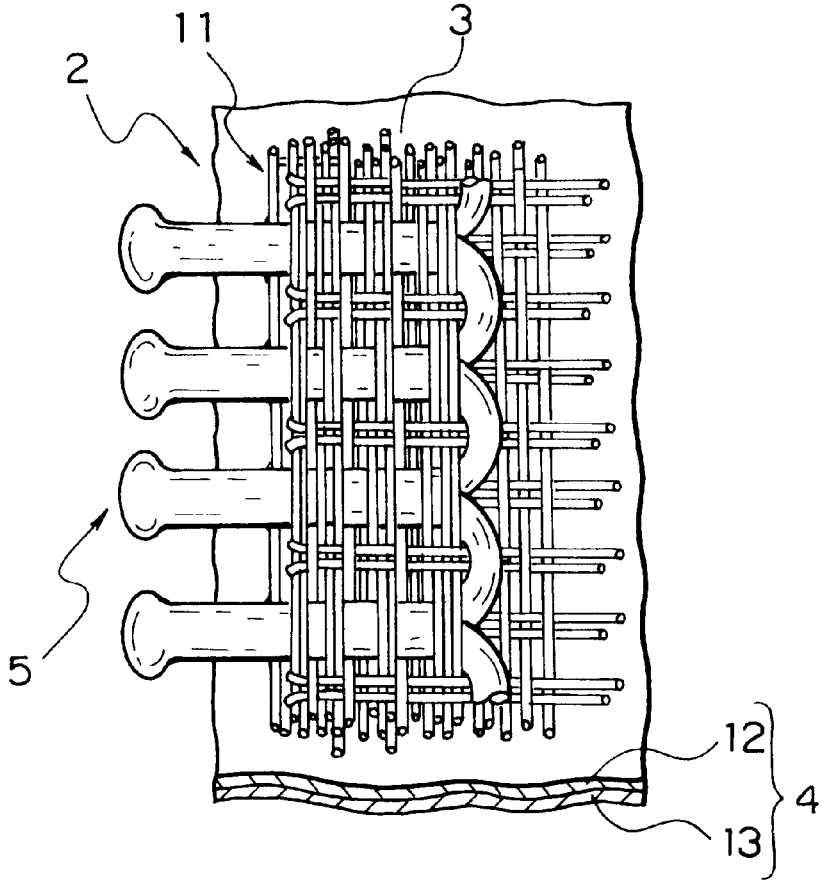
FIG. 16 is a plan view of a fastener stringer according to a fourth embodiment of the slide fastener having waterproof.

In the fastener stringer 2 according to a fourth embodiment shown in FIG. 16, the coil-shaped linear fastener elements 5 are attached to the side edge 11 of the fastener tape 3 by weaving in at the time of weaving the fastener tape 3. The laminated synthetic resin film 4 composed of the low melting point resin layer 12 and high melting point resin layer 13 is fused to the rear surface of the fastener tape 3 such that it protrudes from the side edge 11 of the fastener tape 3. Meanwhile, it is permissible to attach the coil-shaped linear fastener elements 5 to the side edge 11 by knitting and fuse the laminated synthetic resin film 4 to the rear surface of the fastener tape 3.

Figure 17:
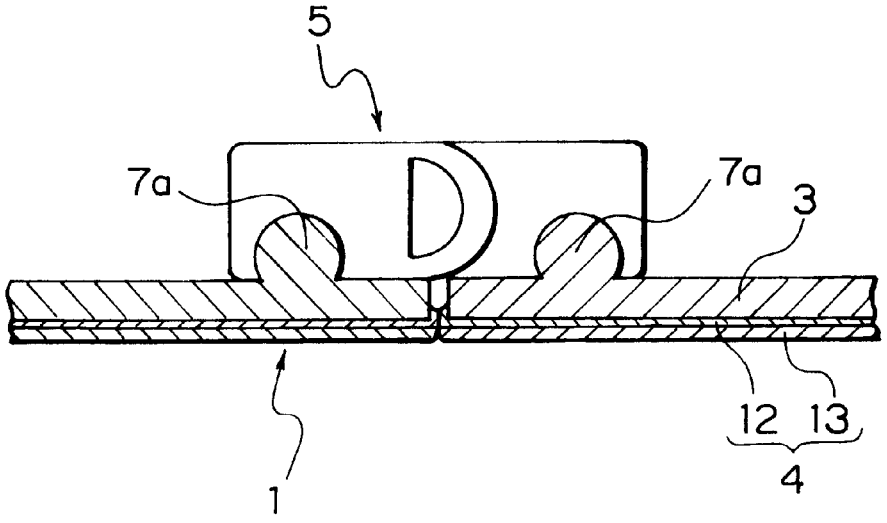
FIG. 17 is a sectional view of a fastener stringer according to a fifth embodiment of the slide fastener having waterproof.

In the fastener chain 1 according to a fifth embodiment shown in FIG. 17, a swollen core portion 7*a* is formed on the side edge 11 of the fastener tape 3 and a metallic discrete fastener element 5 is attached by crimping to the core portion 7*a*. The laminated synthetic resin film 4 composed of the low melting point resin layer 12 and high melting point resin layer 13 is fused to the rear surface of the fastener tape 3 such that it protrudes from the side edge 11 of each of a pair of the fastener tapes 3. The laminated synthetic resin films 4 fused to each of the fastener tapes 3 collide with each other between the side edges 11. It is also permissible to attach a discrete fastener element of synthetic resin directly to the core portion 7*a* by injection molding means.

Figure 18:
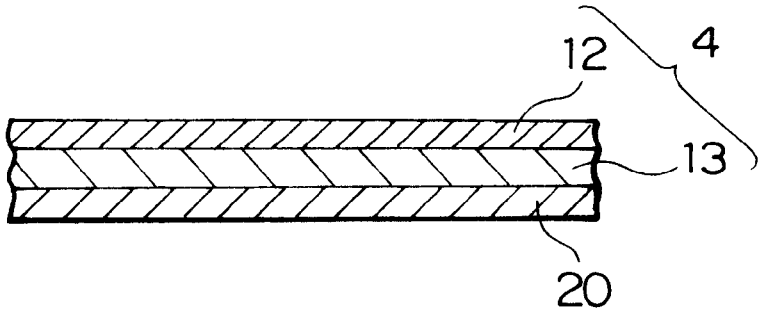
FIG. 18 is a fragmentary sectional view in an enlarged scale showing a modification of a laminated synthetic resin film.
Figure 19:
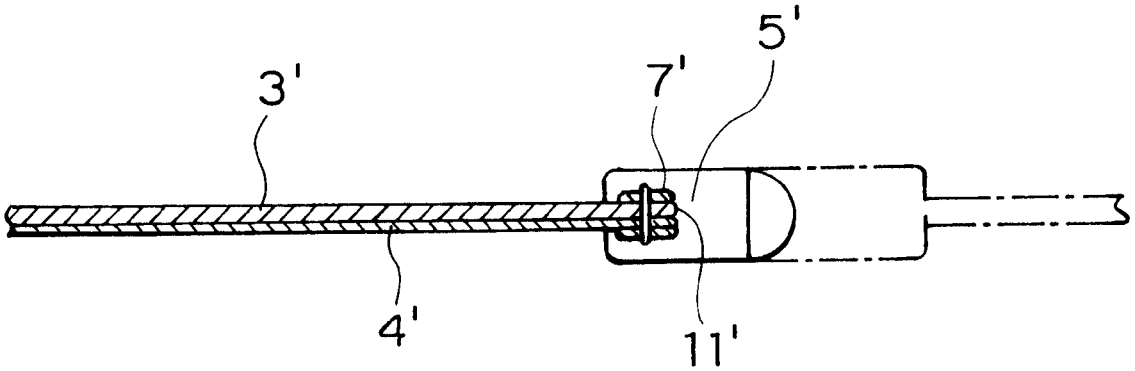
FIG. 19 PRIOR ART
FIG. 19 is a sectional view of a well known slide fastener having waterproof.

FIG. 18 shows a modification of the laminated synthetic resin film 4. According to the laminated synthetic resin film 4, in addition to the low melting point resin layer 12 and high melting point resin layer 13, a synthetic resin layer 20 is further disposed on the surface of the high melting point resin layer 13. In this laminated synthetic resin film 4, for example, the melting point of the low melting point resin layer 12 is 100° C.–150° C., that of the high melting point resin layer 13 is 150° C.–200° C. and that of the synthetic resin layer 20 is 200° C.–220° C. The synthetic resin layer 20 is disposed appropriately depending on an application of the fastener chain. The synthetic resin layer 20 may have a melting point higher than 220° C., provided with unevenness pattern or fabric pattern on the surface thereof by embossing or the like or provided with a ultraviolet ray protecting function.

The waterproof slide fastener and the manufacturing method of the present invention have been described above and the following effects are obtained.

According to the invention, the laminated synthetic resin film 4 composed of low melting point resin layer 12 and high melting point resin layer 13 is fused to at least one surface of the fastener tape 3 in the slide fastener such that the low melting point resin layer 12 is in contact with and opposes the surface of the fastener tape 3 while the fastener elements 5 are mounted on the side edge 11 of the fastener tape 3. As a result, the laminated synthetic resin film 4 can be fused to the fastener tape 3 securely so as to provide the fastener tape 3 with waterproofness and prevent an occurrence of a portion in which the synthetic resin film does not exist locally due to heating the surface of the synthetic resin film or due to threading of the sewing yarns, namely, an occurrence of perforation phenomenon. Thus, a slide fastener having an good appearance is obtained.

According to the invention, the melting points of the low melting point resin layer 12 and high melting point resin layer 13 in the laminated synthetic resin film 4 are specified. As a result, the laminated synthetic resin film 4 never peels from the fastener tape 3 upon dry cleaning and can be fused to the fastener chain securely and easily.

According to the invention, the laminated synthetic resin film 4 to be fused to the fastener tape 3 is formed so as to protrude from the side edge 11 of the fastener tape 3 and the center point of coupling of the fastener elements 5. As a result, waterproof function at the side edges 11 in which the right and left fastener tapes 3 collide with each other can be achieved with a simple structure.

According to the invention, the fastener elements 5 are mounted on the front surface of the side edge 11 of the fastener tape 3 and the laminated synthetic resin film 4 is fused on the rear surface of the fastener tape 3. As a result, it is possible to provide a fastener chain 1 in which the slide fastener is mounted on the rear surface thereof with waterproof function with a simple structure.

According to the invention, the laminated synthetic resin film 4 is fused on the front surface of the fastener tape 3 and the fastener elements 5 are mounted on the front surface of the side edge 11 of the fastener tape 3. Thus, it is possible to provide the fastener chain 1 in which the slide fastener is mounted on the front surface thereof with waterproof function with a simple structure.

According to the invention, the laminated synthetic resin film 4 is fused on the front surface of the fastener tape 3 and linear fastener elements 5 are sewn onto the front surface of the side edge 11 of the fastener tape 3 while the rear surface of the portion to which the fastener elements 5 are sewn is treated with waterproof finish. As a result, water leakage or water penetration along the portion of the sewing yarns 6 for fixing the fastener elements 5 in the fastener chain 1 in which the slide fastener is mounted on the front surface thereof is prevented securely so as to enhance the waterproof.

According to the invention, the laminated synthetic resin film 4 is fused on the front surface of the fastener tape 3 and linear fastener elements 5 are sewn onto the front surface of the side edge 11 of the fastener tape 3 while sewing yarns 6 with which the fastener elements 5 are fixed are treated with waterproof finish. As a result, water leakage or water penetration along the portion of the sewing yarns 6 for fixing the fastener elements 5 in the fastener chain 1 in which the slide fastener is mounted on the front surface can be prevented securely and easily by modification on the sewing yarns so as to intensify the water resisting effect.

According to the invention, the laminated synthetic resin film 4 is fused on the surface of the fastener tape 3, a pair of the linear fastener elements 5 are disposed on the surface such that they oppose with their coupling heads opposing each other across a predetermined interval, the fastener tape 3 is bent at the middle between the pair of the linear fastener elements 5 so that the bent portions overlap, while the overlapping faces of the fastener tape 3 are bonded to each other. As a result, this slide fastener has fastener elements 5 on both surfaces of the fastener tape 3. Water leakage or water penetration in the side edge 11 in which the fastener stringers 2 collide with each other can be prevented securely with a simple structure so that airtightness and watertightness can be secured.

According to the invention, fastener elements 5 are mounted on the surface of the side edge 11 of each of the pair of fastener tapes 3; the right and left linear fastener elements 5 are coupled with each other, and then the laminated synthetic resin film 4 composed of low melting point resin layer 12 and high melting point resin layer 13 is heated under pressure onto the rear surface of each of the pair of combined fastener tapes, with the low melting point resin layer 12 being in contact with and opposing the fastener tape 3, so as to fuse the low melting point resin layer 12 to the fastener tape 3; the laminated synthetic resin film 4 is cut between the right and left fastener tapes 3 so as to produce a fastener chain 1. As a result, waterproof is provided to the fastener tape 3 and portions in which the synthetic resin film does not exist locally due to fusion of the synthetic resin film by heating are not generated, namely, perforation phenomenon is prevented. Further, the laminated synthetic resin film 4 can be fused securely to the fastener tape 3, so that a slide fastener having a good appearance can be produced easily with a simple manufacturing process.

According to the invention, after the right and left fastener elements 5 mounted to the pair of the fastener tapes 3 are coupled, the fastener elements 5 are kept with a gap between opposing side edges 11 thereof by pulling the right and left fastener tapes 3 to the right and left or arranging the fastener elements in a mountain shape to project toward the fastener tape side while the laminated synthetic resin film is fused to the fastener tapes. As a result, the waterproof function between the side edges 11 of the fastener tape 3 can be intensified by a simple manufacturing process. That is, the effects of the present invention are quite remarkable.

What is claimed is:

1. A waterproof slide fastener, wherein a laminated synthetic resin film composed of low melting point resin layer and high melting point resin layer is fused to an entire surface of at least one face of a fastener tape in the slide fastener such that the low melting point resin layer is in contact with and opposes the surface of the fastener tape while fastener elements are mounted on a side edge of the fastener tape.

2. A waterproof slide fastener according to claim 1, wherein the laminated synthetic resin film is comprised of the low melting point resin layer having melting point of 100° C.–140° C. and the high melting point resin layer having melting point of 150° C.–230° C.

3. A waterproof slide fastener according to claim 1, wherein the laminated synthetic resin film is comprised of the low melting point resin layer having melting point of 110° C.–130°C. and the high melting point resin layer having melting point of 160° C.–200° C.

4. A waterproof slide fastener according to claim 1, wherein the laminated synthetic resin film to be fused to the fastener tape is formed so as to protrude from the side edge of the fastener tape and a center point of coupling of the fastener elements.

5. A waterproof slide fastener according to claim 1, wherein the fastener elements are mounted on a front surface of the side edge of the fastener tape and the laminated synthetic resin film is fused on a rear surface of the fastener tape.

6. A waterproof slide fastener according to claim 1, wherein the laminated synthetic resin film is fused on the front surface of the fastener tape and the fastener elements are mounted on the front surface of the side edge of the fastener tape.

7. A waterproof slide fastener according to claim 6, wherein the laminated synthetic resin film is fused on the front surface of the fastener tape and linear fastener elements are sewn onto the front surface of the side edge of the fastener tape while a portion of a rear surface of the tape to which the fastener elements are sewn is treated with waterproof finish.

8. A waterproof slide fastener according to claim 6, wherein the laminated synthetic resin film is fused on the front surface of the fastener tape and linear fastener elements are sewn onto the front surface of the side edge of the fastener tape while sewing yarns with which the fastener elements are fixed are treated with waterproof finish.

9. A waterproof slide fastener according to claim 1, wherein the laminated synthetic resin film is fused on the front surface of the fastener tape, a pair of the linear fastener elements are disposed on the front surface such that they oppose and coupling heads oppose each other across a predetermined interval, the fastener tape is bent at the middle between the pair of linear fastener elements so as to overlap, while the overlapping faces of the fastener tape are bonded to each other.

* * * * *